US006244139B1

(12) United States Patent
Huang

(10) Patent No.: US 6,244,139 B1
(45) Date of Patent: Jun. 12, 2001

(54) ADJUSTABLE SHIFTER FOR CONTROLLING THE RACING OF A SLIDEABLE RATCHET SHANK

(76) Inventor: Daniel Huang, P.O. Box 697, Feng-Yuan City 420 (TW)

( * ) Notice: Subject to any disclaimer, the term of this patent is extended or adjusted under 35 U.S.C. 154(b) by 0 days.

(21) Appl. No.: 09/599,031

(22) Filed: Jun. 20, 2000

(51) Int. Cl.[7] ..... B25B 13/46
(52) U.S. Cl. ..... 81/63.2; 192/43.2
(58) Field of Search ..... 81/63.1, 63.2, 81/438, 439, 177.1, 177.2, 177.85; 192/43.2

(56) References Cited

U.S. PATENT DOCUMENTS 5,642,794 * 7/1997 Chuang et al. ..... 81/63.1 X
5,910,196 * 6/1999 Huang ..... 81/63.1 X
6,148,696 * 11/2000 Chiang ..... 81/63.1
6,151,995 * 11/2000 Shu ..... 81/63.1
6,155,144 * 12/2000 Lin ..... 81/438

* cited by examiner

*Primary Examiner*—D. S. Meislin

(57) ABSTRACT

An adjustable shifter for controlling the racing of a slidable ratchet shank includes a tubular handle for slidably disposed therein a shank of socket wrench which has a plurality of annular grooves on front outer periphery and ratchet on rear outer periphery, a shifting mechanism wrapped on the rear outer periphery of the shank having a shifter elastically engaged with the ratchet and positioning mechanism wrapped on the front outer periphery of the shank including a catch ring engaged with the annular grooves of the shank. It is characterized that when turns the shifter for 180 degrees, the shank will change its racing direction and when disengages the catch ring with the annular grooves, the shank is free to slide within the handle to change its length relative to the handle.

5 Claims, 7 Drawing Sheets

ADJUSTABLE SHIFTER FOR CONTROLLING THE RACING OF A SLIDEABLE RATCHET SHANK

BACKGROUND OF THE INVENTION

The present invention relates to tools and more particularly to an adjustable shifter for controlling the racing of a slidable ratchet shank which shifter is slidably shifting its direction in order to control the positive and/or inverse racing of the slidable ratchet bar.

Normally a shank of a screwdriver or a socket wrench is secured to a handle. Some of the shanks includes a ratchet bar which is controlled by a shifter can only racing on one direction. FIGS. 1 and 2 show a ratchet socket wrench which comprises a handle 10, a sleeve 12 and a chuck 13. The handle 10 has a chamber 101 enabling to receive a ratchet 111 of the wrench 11, a pair of pawls 112 and 113 and a positioning plate 14. The sleeve 12 is wrapped on the chamber 101 of the handle 10 and secured by the chuck 13. A shifter 121 slidably disposes in the top of the sleeve 12 to levelly actuate the pawls 112 and 113 which control the ratchet 111 racing on one direction. However, the socket wrench is fixed to the handle 10, its length is therefore unadjustable.

SUMMARY OF THE PRESENT INVENTION

The present invention has a main object to provide an adjustable shifter for controlling the racing of a slidable ratchet. The shifter is slidably engaged with the ratchet and an be readily rotated for 180 degrees to change the racing direction of the ratchet on a shank of a socket wrench which has a plurality of annular grooves spacedly formed on the body can be shifting about the chuck to change its length in the handle.

The present invention will become more fully understood by reference to the following detailed description thereof when read in conjunction with the attached drawings.

DETAILED DESCRIPTION OF THE PREFERRED EMBODIMENT

Figure 1:
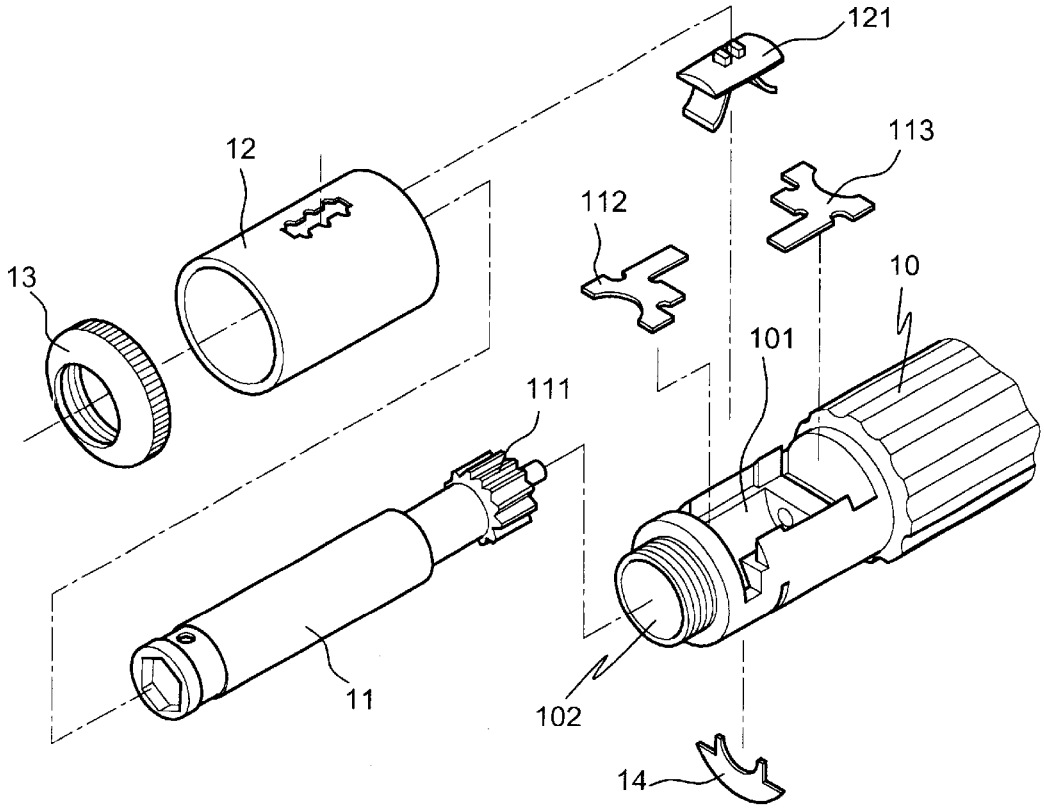
FIG.1 Prior Art
FIG. 1 is an exploded perspective view to show a ratchet socket wrench according to a prior art.
Figure 2:
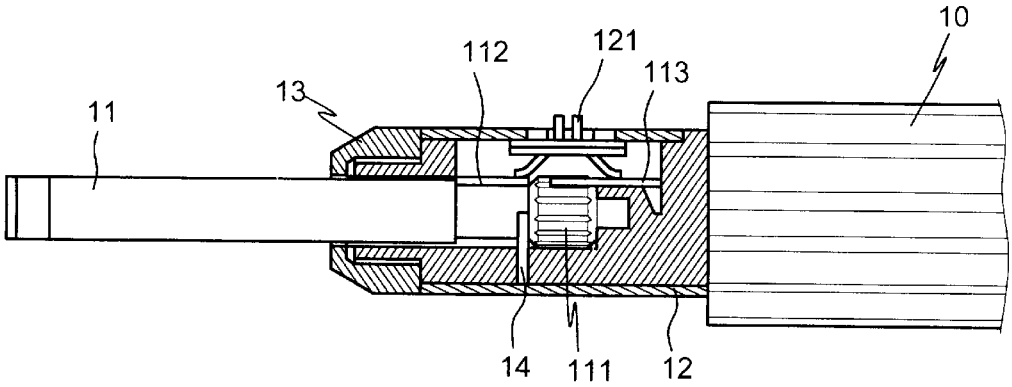
FIG.2 Prior Art
FIG. 2 is a sectional view to show an assembly of FIG. 1.
Figure 3:
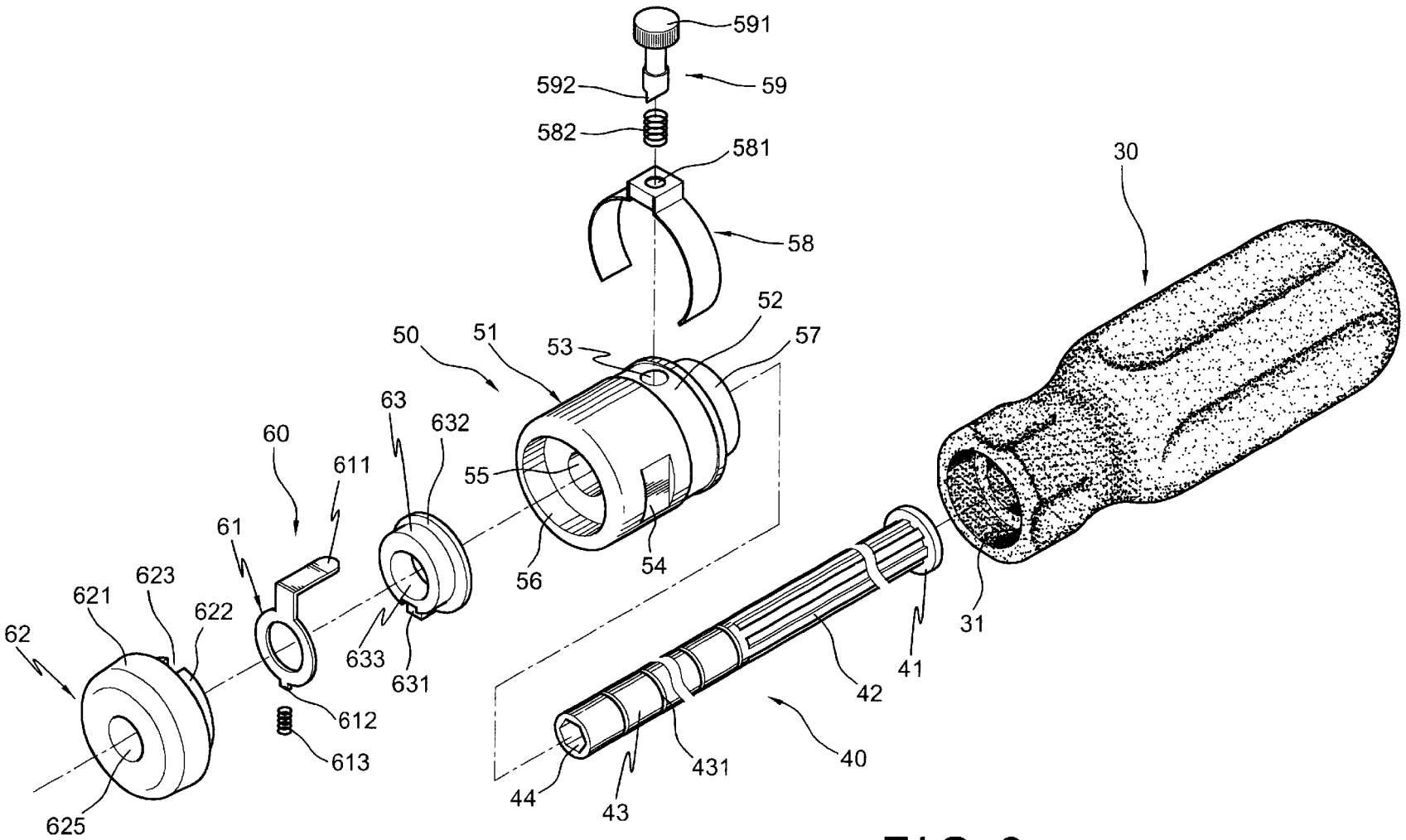
FIG. 3 is an exploded perspective view to show a ratchet socket wrench according to the present invention.

With reference to FIG. 3 of the drawings, the adjustable shifter for controlling the racing of a slidable ratchet shank comprises generally a tubular handle 30, a shank 40 insertible into the handle 30, a shifting mechanism 50 controlling the racing directions of the shank 40 and a positioning mechanism 60 controlling the changing of length of the shank 40.

The tubular handle 30 has an opening 31 in front end.

The shank 40 has a flange 41 at rear end, a ratchet portion 42 abutting the flange 41, a socket wrench 44 in front end and a shifting portion 43 abutting the wrench 44 including a plurality of small annular grooves 431 spacedly formed on outer periphery.

The shifting mechanism 50 includes a sleeve 51 wrapped on the shank 40 having a large annular groove 52 abutting rear end, a thru hole 53 in the groove 52, a pair of concaves 54 is opposing outer peripheries which is provided to facilitate the sleeve 51 to be operated by a wrench or other appropriate tools, a central bore 55 for slidably receiving the shank 40, an enlarged opening 56 in front end and a reduced rear end 57 frictionally engageable into the opening 31 of the handle 30, an elastic clamp 58 engaged into the large annular groove 52 of the sleeve 51 including a protrudent thru hole 581 engageable with the thru hole 53 and a shifter slidably disposed into the thru holes 581 and 53 and biased by a spring 582. The shifter 59 has a turning button 591 and a bevel pawl 592 engageable into the ratchet portion 42 of the shank 40.

Figure 8:
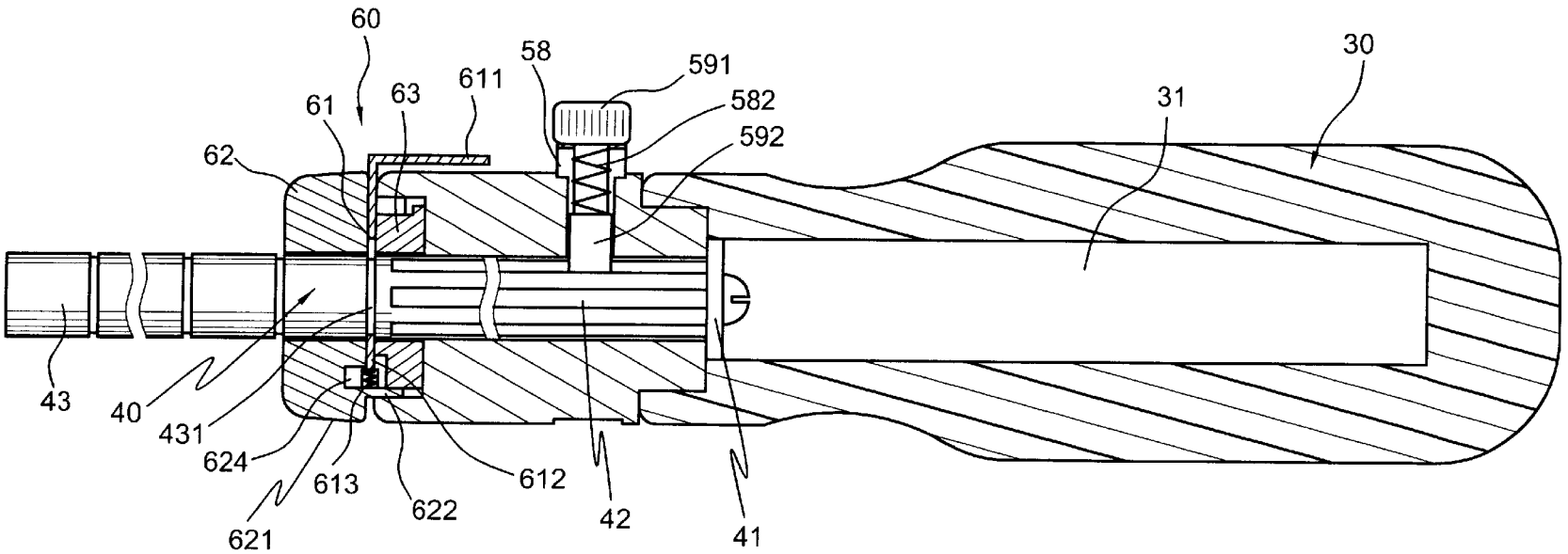
FIG. 8 is a sectional view indicating that the shank is remaining at its original position.
Figure 9:
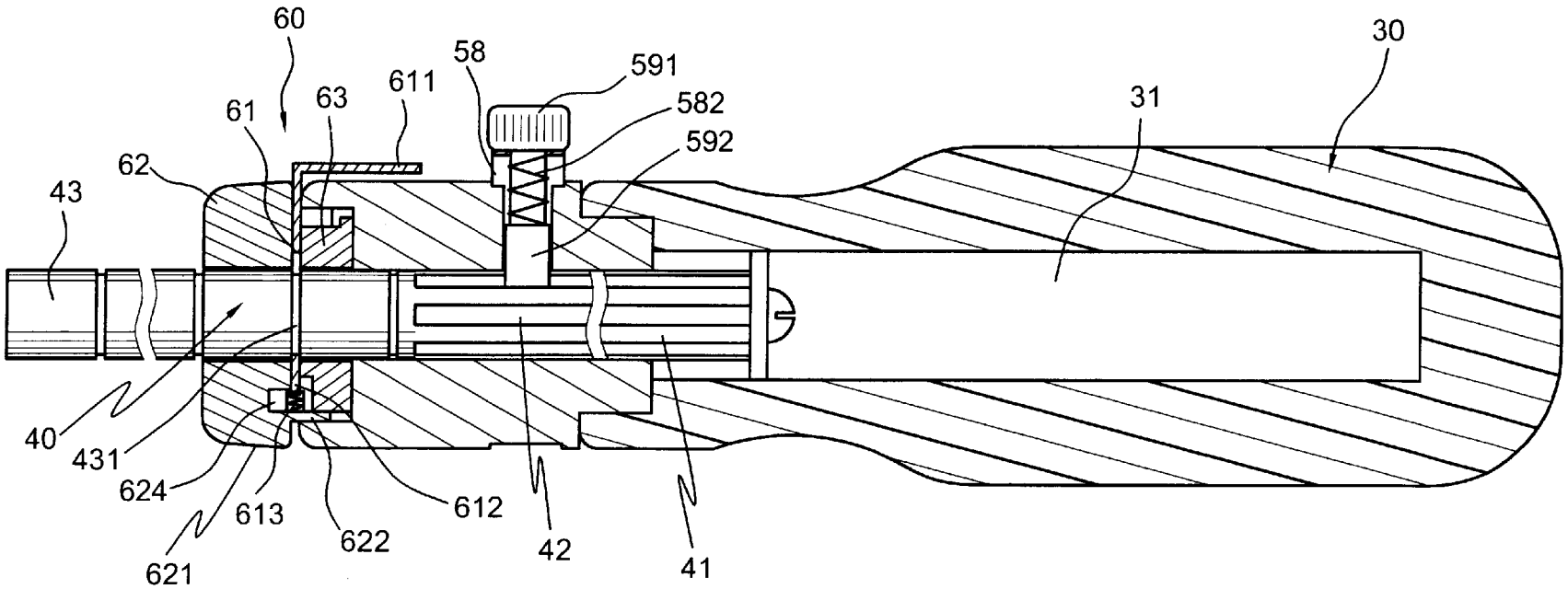
FIG. 9 is a sectional view indicating that the shank is shifted inward into the handle.
Figure 10:
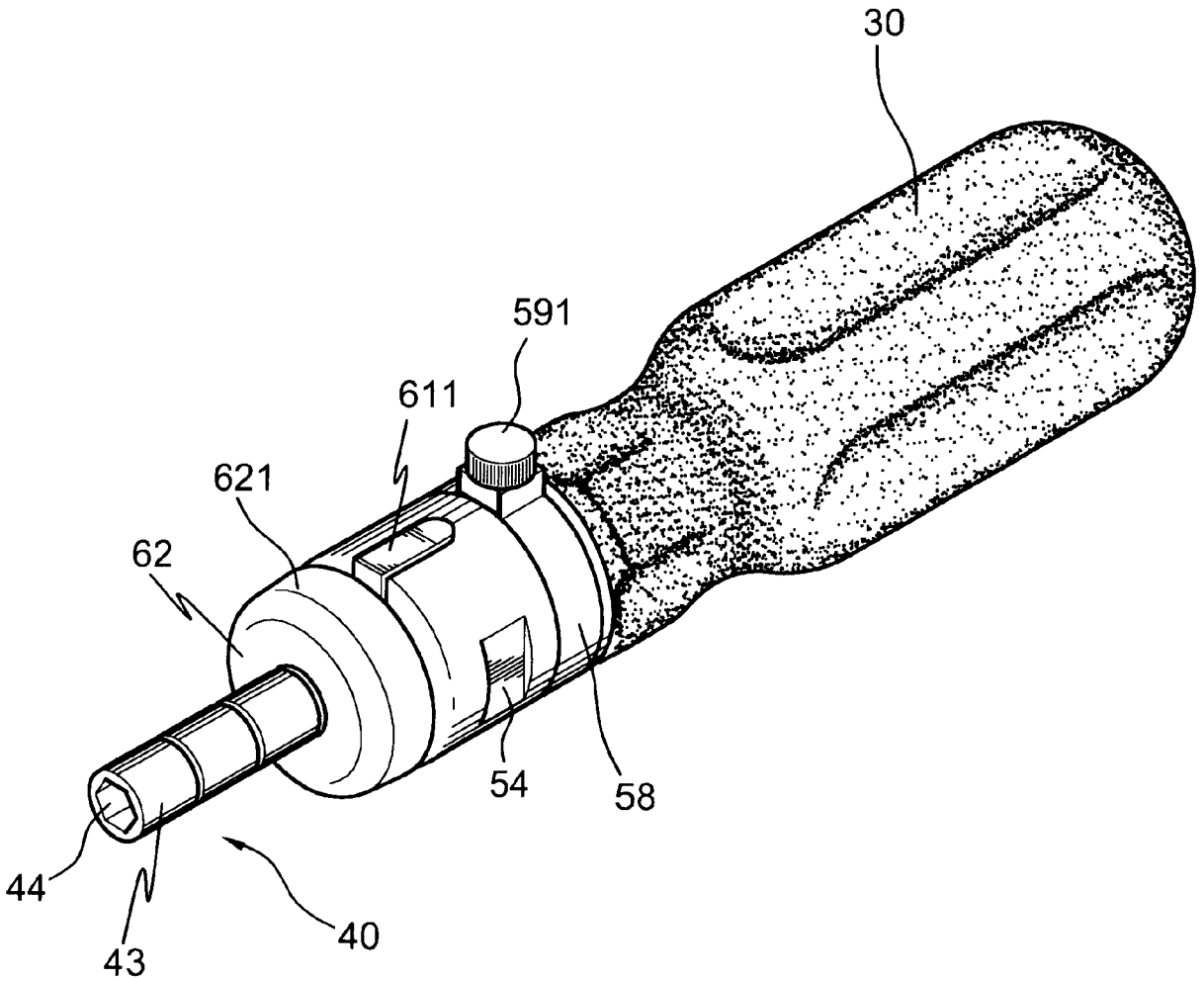
FIG. 10 is a perspective to show an outlook of the ratchet socket wrench of the present invention.

The positioning mechanism 60 has a ferrule 63 wrapped on the shank 40 and including a projection 631 projected downward from a lower outer periphery abutting a rear flange 632 which engages into the large opening 56 of the sleeve 51 and a central bore 633 made in registry with the central bore 55 of the sleeve 51, a catch ring 61 wrapped on the shank 40 in front of the ferrule 63 and including an extension 612 extending downward from a lower outer periphery and a roughly L-shaped press plate 611 extending upward from an upper outer periphery, and a chuck 62 wrapped on the shank 40 being positioned at outmost position of the positioning mechanism 60 and including a large out periphery 621, a reduced portion 622 extending rearward from the outer periphery 621 frictionally engaged into the large opening 56 of the sleeve 51 between the ferrule 63 and the inner periphery of the opening 56, a first notch 623 in an upper periphery of the reduced portion 622 for receiving the L-shaped press plate 611 of the catch ring 61, a second notch 624 in a lower inner surface abutting the lower inner periphery of the reduced portion 622 for receiving a spring 613 which biases the projection 612 of the catch ring 61 against an inner periphery of the reduced portion 622 (as shown in FIG. 8 and 9) and a central bore 625 made in registry with the central bore 55 of the sleeve 51. When all the components of the ratchet socket wrench are assembled, the flange 41 of shank 40 is stopped against the reduced rear end 57 of the sleeve 51 and the catch ring 61 is engaged with an inmost annular groove 431 of the sliding portion 43 of the shank 40. So that the wrench is stable. FIG. 10 shows an outlook of the assembled ratchet socket wrench of the present invention.

Figure 5:
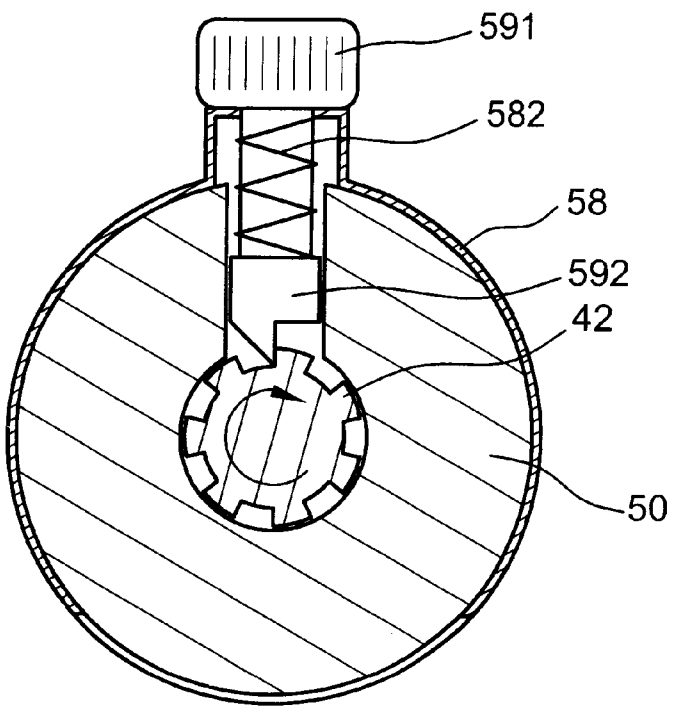
FIG. 4 and 5 are the sectional views to show the operations of an adjustable shifter.
Figure 4:
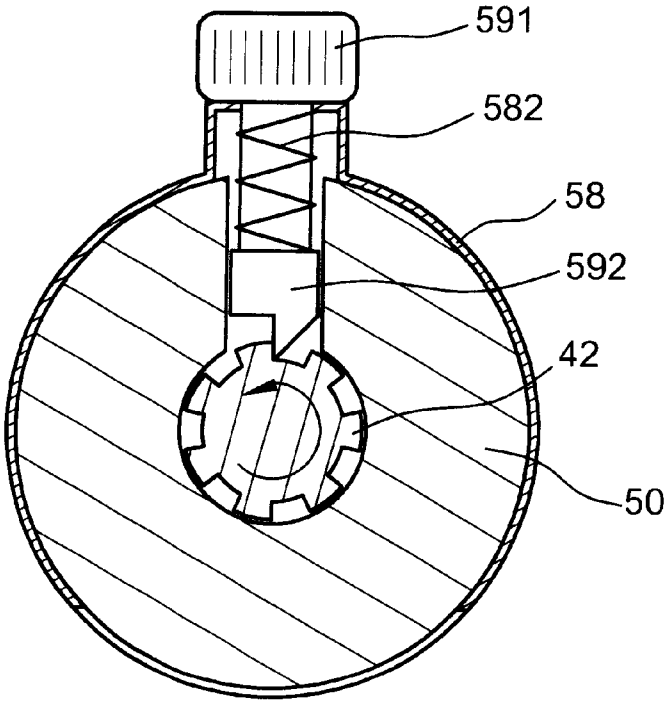

Referring to FIG. 4 and 5 which show that the bevel pawl 592 of the shifter 59 is engaged with the ratchet portion 42 of the shank 40 to control the racing direction of the shank 40. When the bevel is on a right side relative to the shifter 59, the shank 40 can only be racing counterclockwise (as shown in FIG. 4). If draw the shifter 59 upward and turn the button 591 for 180 degrees and release the shifter 59, the bevel pawl 592 is automatically engaged with the ratchet portion 42 again for the resilience of the spring 582 and the bevel is now on the left side relative to the shifter 59, so that the shank 40 can only be racing clockwise. This changing of racing directions is operated very easy and convenient than any prior art equivalent.

Figure 7:
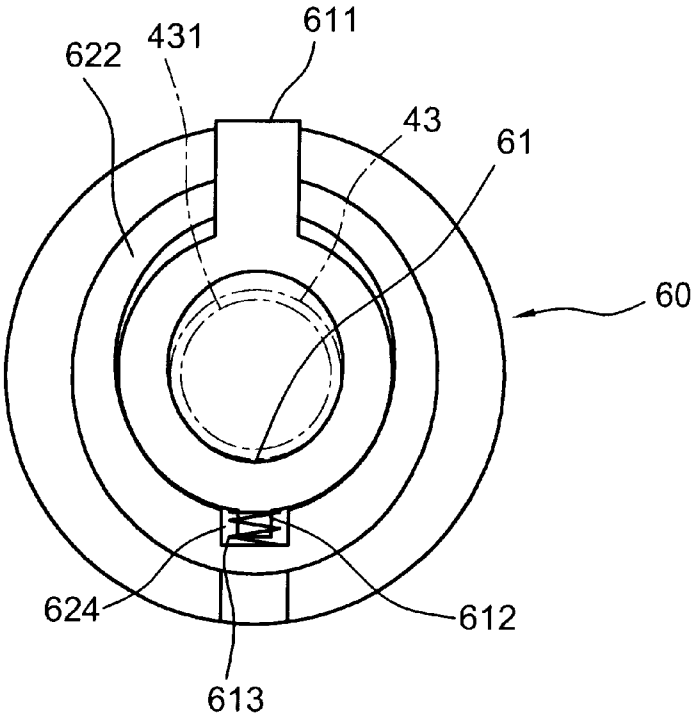
FIG. 6 and 7 are the sectional views to show the operations of a catch ring.
Figure 6:
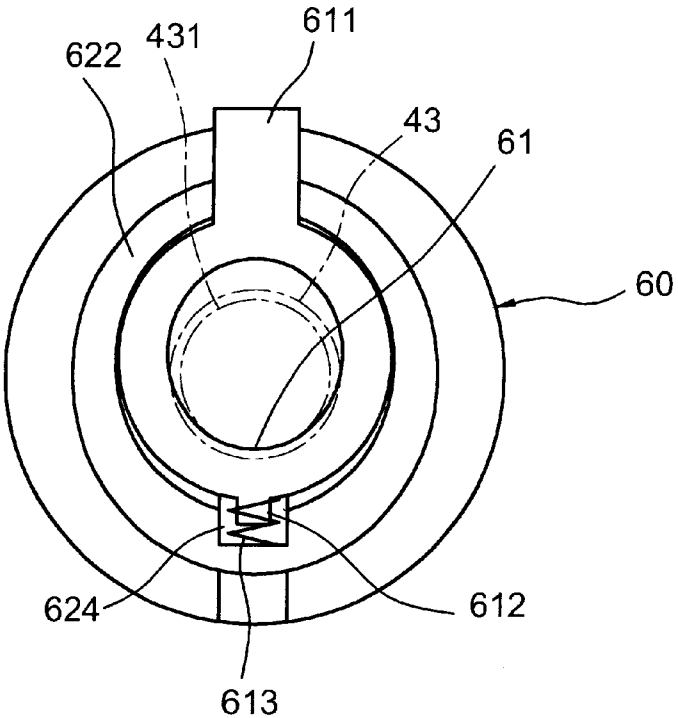

Referring to FIGS. 6 and 7, the catch ring 61 is normally engaged with any of the small annular grooves 431 of the sliding portion 43 of the shank 40 (as shown in FIG. 6) so that the shank is stable. When press the press plate 611 downward to disengage the catch ring 61 with the annular groove 431, the shank becomes free to slide about sleeve 51 so that the user can change the desired length for the shank, when release the press plate 611, the catch ring 61 will automatically engage with any of the annular grooves 431 to prevent the shank 40 from movement (as shown in FIG. 7). However, the shank 40 is already shifted inward into the handle 30 (as shown in FIG. 9). You'll see that the longitudinal movement of the shank 40 does not affect the engagement of the shifter 59 with the ratchet portion 42. The change of the length for the shank 40 relative to the handle 30 facilitates the user working in a narrow space and/or fixing the ratchet socket wrench into a small sized tool box. So that is very important.

The specification relating to the above embodiment should be construed as exemplary rather than as limitative of the present invention, with many variations and modifications being readily attainable by a person of average skill in the art without departing from the spirit or scope thereof as defined by the appended claims and their legal equivalents.

I claim:

1. An adjustable shifter for controlling the racing of a slidable ratchet shank comprising:

a tubular handle having an opening in a front end thereof;

a shank inserted into the opening of the handle and having a socket wrench in a front end, a first flange at a rear end, a ratchet portion on an outer periphery abutting the rear end and a sliding portion on an outer periphery abutting the front end including a plurality of small annular grooves formed spaced apart;

a sleeve member wrapped on the shank having a first reduced rear end frictionally engaged into the opening of the handle and stopped against the flange of the shank, a large annular groove abutting the rear end, a thru hole in the large annular groove, a pair of concaves formed in opposing outer peripheries, a first central bore slidably engaged with the shank and a large opening in front end communicating with the central bore;

an elastic clamp disposed into the large annular groove of the sleeve member having a protrudent thru hole in a center thereof engaged with the thru hole of the sleeve member;

a shifter having a turning button on top and a bevel pawl at lower end inserted into the sleeve member via the thru holes of the clamp and the sleeve member and engaged with the ratchet portion of the shank;

a first spring means biasing the shifter inside said sleeve member;

a ferrule member wrapped on said shank having a second flange engaged into the large opening of said sleeve member, a first projection projected downward from a lower outer periphery and a second central bore engaged with the first central bore of said sleeve member;

a chuck member wrapped on said shank and positioned at an outmost position on said shank having a second reduced rear end frictionally disposed into the large opening of said sleeve member positioned between the first projection of the ferrule member and an inner periphery of the large opening, a first notch in an upper periphery of the second reduced rear end, a second notch in a lower inner surface abutting a lower inner periphery of the second reduced rear end, and a third central bore engaged with the second central bore of the ferrule member;

a catch ring slidably disposed between said chuck member and said ferrule member having a L-shaped press plate projected upward from on upper outer periphery and engaged into the first notch of said chuck member and a second projection protected downward from a lower outer periphery and biased by a second spring means against a lower inner periphery of the second reduced rear end of said chuck member.

2. The adjustable shifter as recited in claim 1 wherein said shifter may rotate for 180 degrees to change the racing direction of the shank.

3. The adjustable shifter as recited in claim 1 wherein said catch ring is engaged with the small annular grooves of said shank.

4. The adjustable shifter as recited in claim 1 wherein said shank is slidable when said catch ring disengages with the small annular grooves.

5. The adjustable shifter as recited in claim 1 wherein said second spring means is engaged within the second notch of said chuck member.

* * * * *